US009548011B1

(12) United States Patent
Banks

(10) Patent No.: US 9,548,011 B1
(45) Date of Patent: Jan. 17, 2017

(54) MULTI-MEDIA WARNING SIGN ATTACHABLE TO A FLOOR SIGN

(71) Applicant: Ronald Banks, Waukegan, IL (US)

(72) Inventor: Ronald Banks, Waukegan, IL (US)

( * ) Notice: Subject to any disclaimer, the term of this patent is extended or adjusted under 35 U.S.C. 154(b) by 0 days.

(21) Appl. No.: 14/826,893

(22) Filed: Aug. 14, 2015

(51) Int. Cl.

| | |
|---|---|
| ***G08B 23/00*** | (2006.01) |
| ***G09F 27/00*** | (2006.01) |
| ***G09F 15/00*** | (2006.01) |
| ***G08B 21/22*** | (2006.01) |

(52) U.S. Cl.
CPC ..... *G09F 27/005* (2013.01); *G08B 21/22* (2013.01); *G09F 15/00* (2013.01)

(58) Field of Classification Search
CPC ..... G09F 27/005; G09F 15/00; G08B 21/22
USPC ..... 340/573.1
See application file for complete search history.

(56) References Cited

U.S. PATENT DOCUMENTS

| | | | | |
|---|---|---|---|---|
| 5,467,076 | A * | 11/1995 | Ruocco | G08B 7/06 315/76 |
| 6,003,257 | A * | 12/1999 | Stokes | G09F 15/0062 40/455 |
| D581,304 | S | 11/2008 | Phillips | |
| 7,755,471 | B2 | 7/2010 | Jackson | |

* cited by examiner

*Primary Examiner* — Nader Bolourchi
(74) *Attorney, Agent, or Firm* — Stevenson IP, LLC

(57) ABSTRACT

A multi-media warning sign attachable to a floor sign including a body having a pair of feet, each foot having a lower wall and a first magnet on the lower wall. Each first magnet has an inner wall within the foot and an outer wall coplanar with the lower wall and is engageable either directly to a ferromagnetic mounting surface or to a second magnet on an upper side of a spring-loaded clamp to secure the body to the front and rear panels of a foldable floor-standing sign in an upright position. The body can also be positioned atop a non-ferromagnetic surface. The battery-operated device also includes a lighting assembly with front and rear lights on the body, a sound system for audible warning messages, front and rear motion sensors to activate the lighting assembly and the sound system when nearby pedestrian motion is detected, and a microprocessor.

4 Claims, 5 Drawing Sheets

MULTI-MEDIA WARNING SIGN ATTACHABLE TO A FLOOR SIGN

BACKGROUND OF THE INVENTION

Various types of caution signs with audible and visual warnings therein are known in the prior art. However, what is needed is a multi-media warning sign attachable to a floor sign including a body having a pair of feet, each foot having a lower wall and a first magnet on the lower wall. Each first magnet has an inner wall within the foot and an outer wall coplanar with the lower wall and is engageable either directly to a ferromagnetic mounting surface or to a second magnet on an upper side of a spring-loaded clamp to secure the body to the front and rear panels of a foldable floor-standing sign in an upright position. The body can also be positioned atop a non-ferromagnetic surface. The battery-operated device also includes a lighting assembly with front and rear lights on the body, a sound system for audible warning messages, front and rear motion sensors to activate the lighting assembly and the sound system when nearby pedestrian motion is detected, and a microprocessor.

FIELD OF THE INVENTION

The present invention relates to caution signs, and more particularly, to a multi-media warning sign attachable to a floor sign which includes a first magnet within a pair of feet in the body and a second magnet each of a pair of spring-loaded clamps that engages the first magnet to attach the body to a floor sign.

SUMMARY OF THE INVENTION

The general purpose of the present multi-media warning sign attachable to a floor sign, described subsequently in greater detail, is to provide a multi-media warning sign attachable to a floor sign which has many novel features that result in a multi-media warning sign attachable to a floor sign which is not anticipated, rendered obvious, suggested, or even implied by prior art, either alone or in combination thereof.

To accomplish this, the present multi-media warning sign attachable to a floor sign includes a body having a foot attached to a bottom side thereof proximal each of the right and left sides thereof. Each foot has a lower wall and a first magnet centrally disposed on the lower wall. The first magnet has an inner wall embedded in the foot and an outer wall coplanar with the lower wall. The first magnet is engageable to a ferromagnetic mounting surface to secure the body in an upright position atop the ferromagnetic mounting surface. Also, because the first magnet outer wall is coplanar with the lower wall of the respective foot, rather than extending beyond the lower wall, the body can be also be positioned atop a non-ferromagnetic mounting surface without being magnetically attached to the mounting surface.

A pair of spring-loaded clamps is provided to attach the body to a foldable floor-standing sign having a front panel and a rear panel pivotably connected to the front panel. Each clamp has an upper side and a second magnet disposed on the upper side. The second magnet of each clamp is engageable to the first magnet of one of the respective feet. Each clamp has a maximum width "W" substantially equal to a combined width of an upper side of each of a front and rear panels of the foldable floor-standing sign from a forward side to a rearward side of the foldable floor-standing sign.

Each clamp is configured to securely clamp simultaneously across the upper side of and onto both of the front panel and the rear panels and to secure the body in an upright position atop the foldable floor-standing sign.

A lighting assembly integrated within the body is configured to produce lighting effects and includes a plurality of front lights and rear lights disposed on a front side and a rear side, respectively, of the body. A sound system is also integrated within the body to record, delete and play back a plurality of audible signals and includes each of an amplified front speaker and an amplified rear speaker. A first portion of the audible signals comprises an audible message of "Caution Wet Floor". A second portion of the audible signals comprises an audible message recorded onto the microprocessor.

A front motion sensor and a rear motion sensor are integrated within the body on the front side and the rear side, respectively and are in operational communication with the lighting assembly and the sound system. Each of the front and rear motion sensors is configured for detecting motion from a nearby pedestrian so as to activate the lighting assembly and the sound system when nearby pedestrian motion is detected. A microprocessor, also disposed within the body, has an integrated timer therein. The microprocessor is in operational communication with a power source, the lighting assembly, the sound system, and the front and rear motion sensors.

A switch, disposed on the body, is in operational communication with the microprocessor and has three operational positions: an on-position, an off-position and an auto-position. The power source is disposed within the body and includes at least one battery. The power source is in operational communication with the lighting assembly, the sound system, the front and rear motion sensors, and the microprocessor.

In the on-position, the switch activates the microprocessor whereupon the microprocessor activates the sound system to play back the first portion of the audible signals, activates the timer to control the sound system to play back one of the first portion and the second portion of the audible signals at one of a selected time interval, and activates the lighting assembly to produce the lighting effects. In the off-position, the switch activates the microprocessor whereupon the microprocessor activates solely the lighting assembly to produce the lighting effects. In the auto-position, the switch activates the microprocessor whereupon the microprocessor activates, solely upon the detection of motion by at least one of the front motion sensor and the rear motion sensor, each of the sound system to play back one of the first portion and the second portion of the audible signals and the lighting assembly to produce the lighting effects.

The sound system provides a built-in microphone within the body for receiving the second portion of the plurality of audible signals. The microphone is in operational communication with the microprocessor and, upon activation, permits the recording of the second portion of the audible signals for storage and processing by the microprocessor.

Thus has been broadly outlined the more important features of the present multi-media warning sign attachable to a floor sign so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
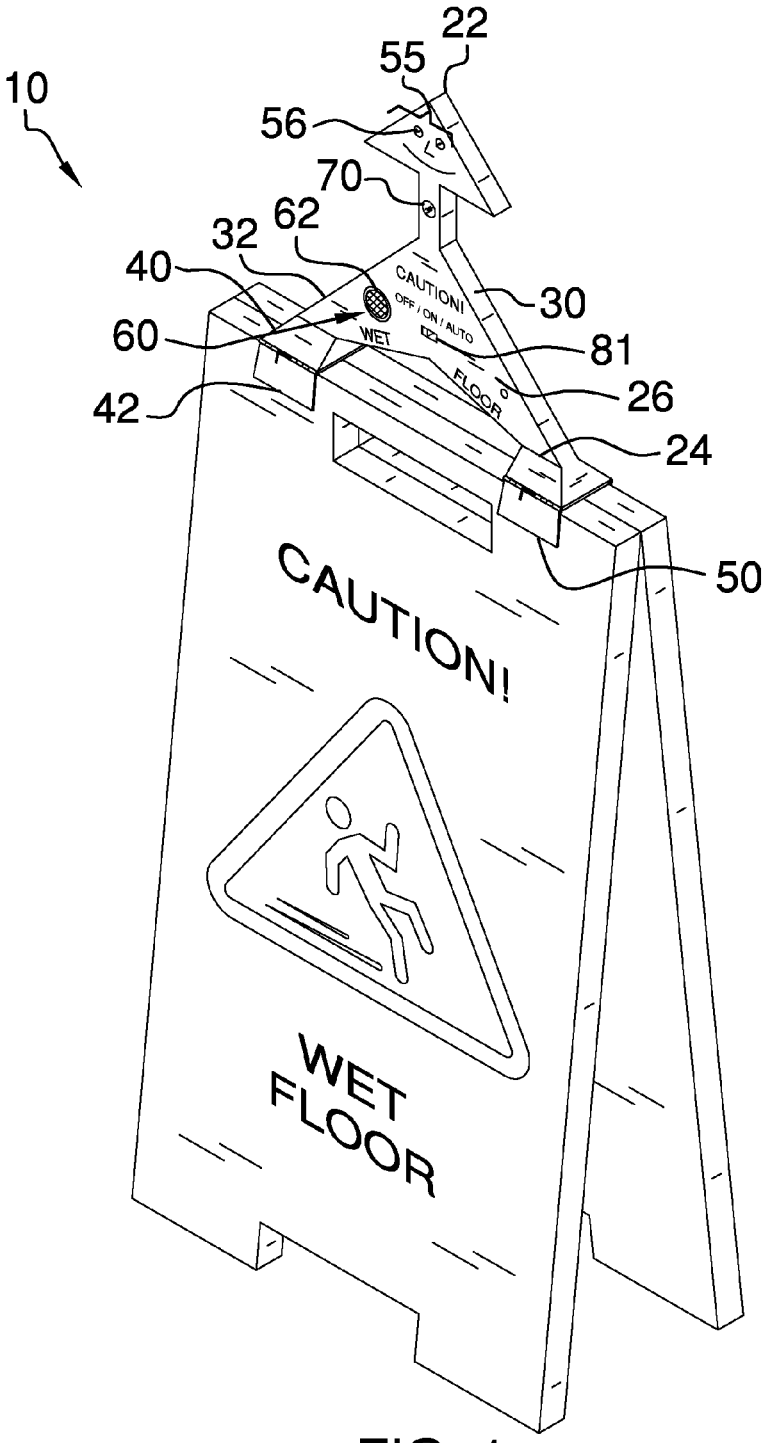
FIG. 1 is an in-use isometric view.
Figure 2:
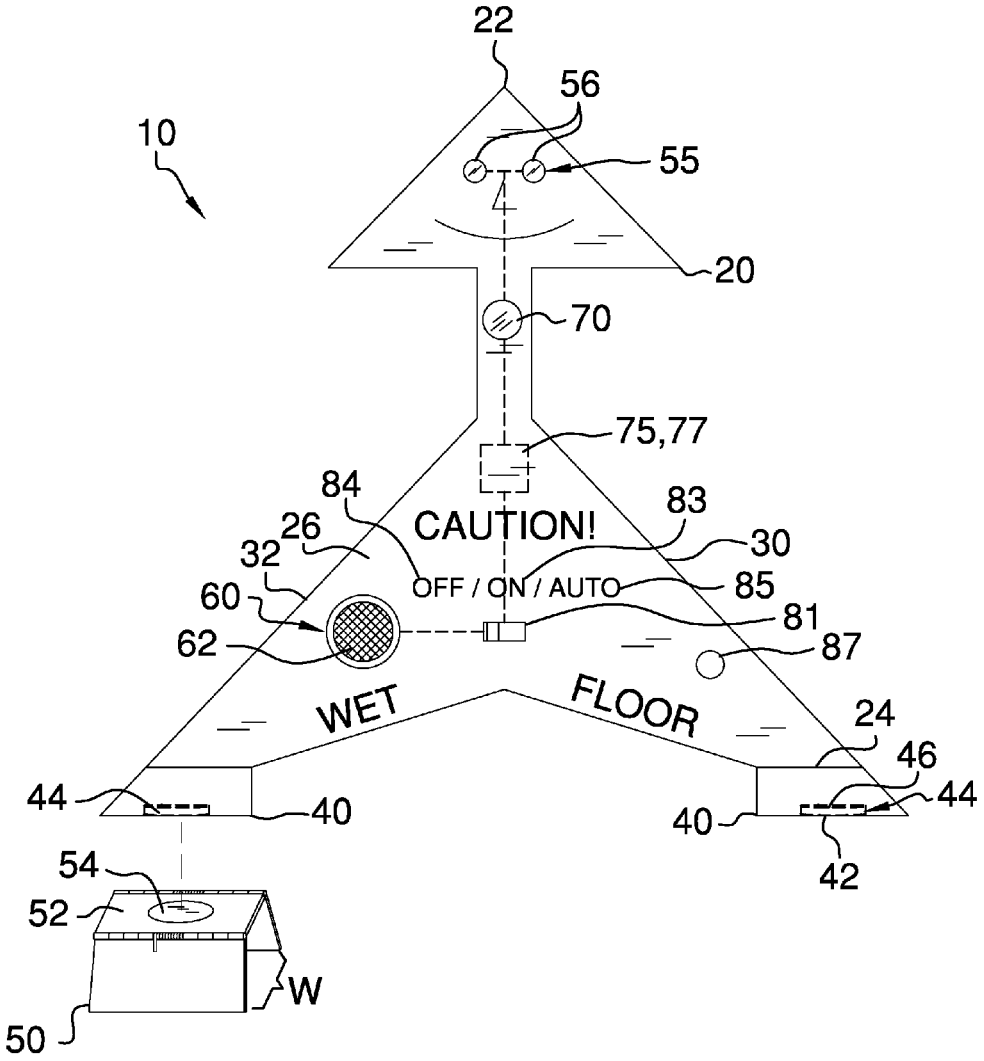
FIG. 2 is a front elevation view.
Figure 4:
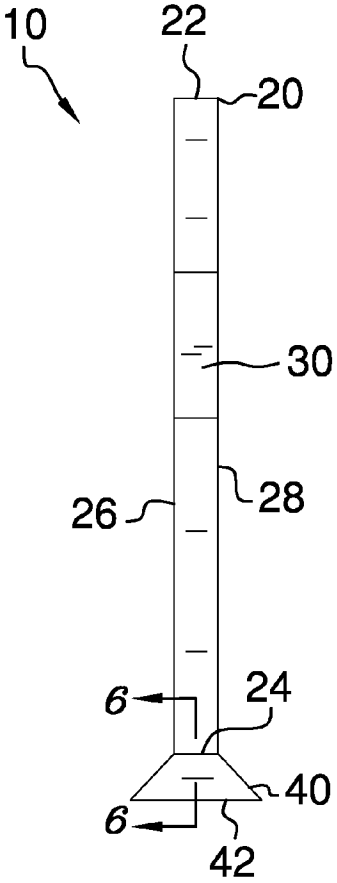
FIG. 4 is a side elevation view.
Figure 3:
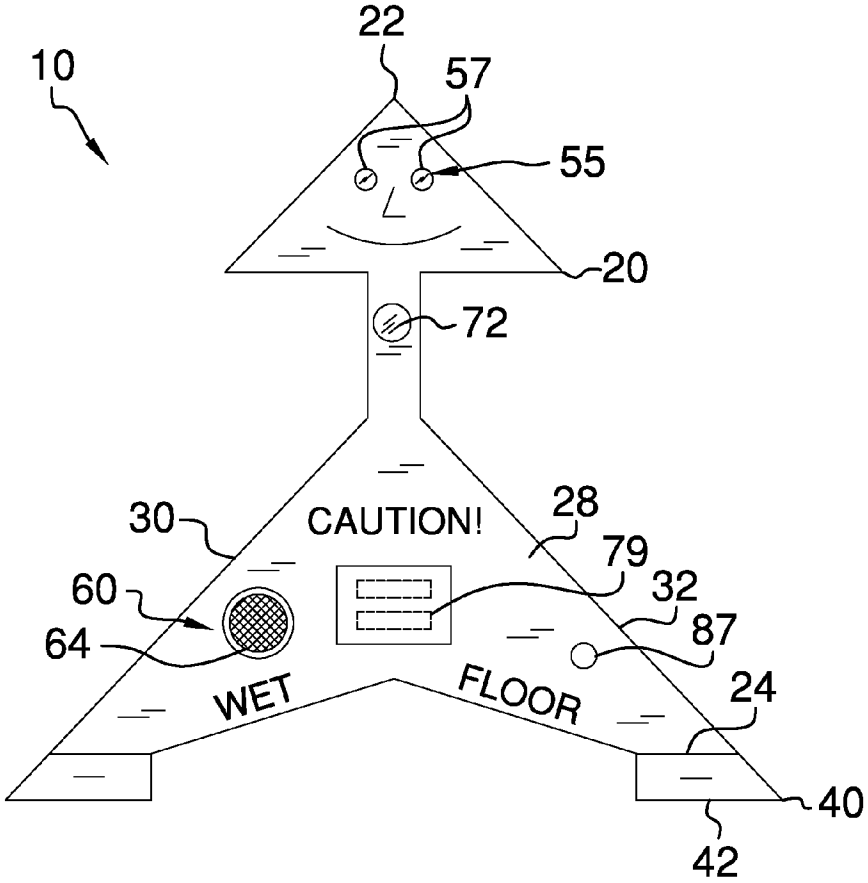
FIG. 3 is a rear elevation view.
Figure 5:
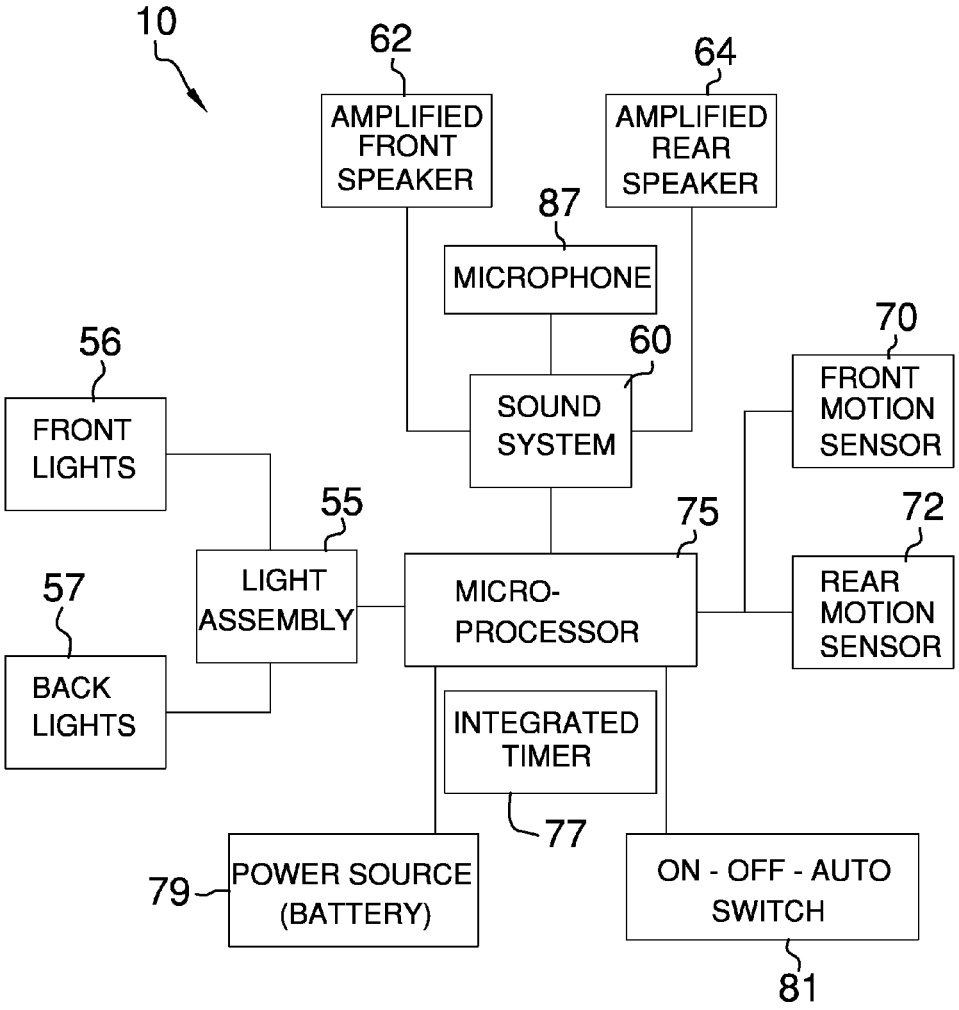
FIG. 5 is a block diagram of operations.
Figure 6:
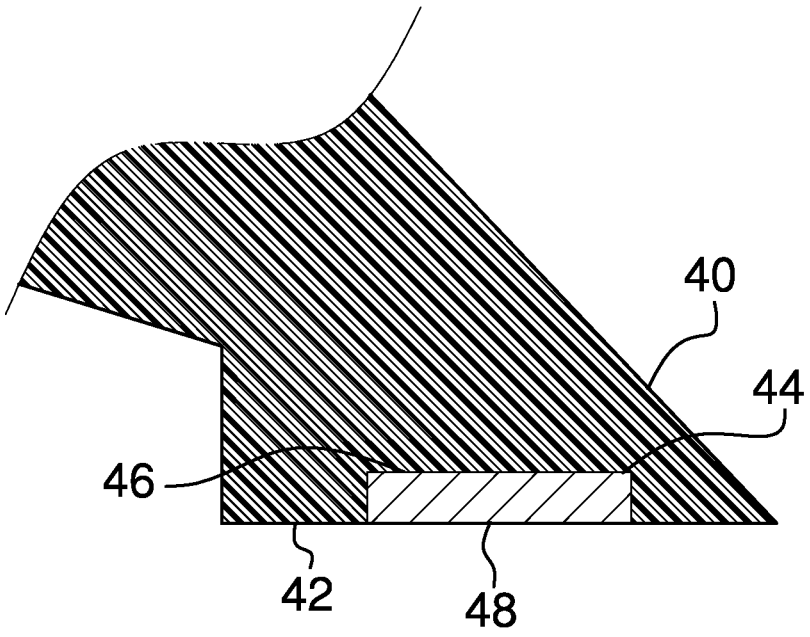
FIG. 6 is a cross-sectional view taken along line 6-6 of FIG. 4.

With reference now to the drawings, and in particular FIGS. 1 through 6 thereof, an example of the instant multi-media warning sign attachable to a floor sign employing the principles and concepts of the present multi-media warning sign attachable to a floor sign and generally designated by the reference number 10 will be described.

Referring to FIGS. 1 through 6 the present multi-media warning sign attachable to a floor sign 10 is illustrated. The multi-media warning sign attachable to a floor sign 10 includes a body 20. The body 20 has a top side 22, a bottom side 24, a front side 26, a rear side 28, a right side 30, and a left side 32. A foot 40 is attached to the bottom side 24 proximal each of the right and left sides 30, 32. Each foot 40 has a lower wall 42 and a first magnet 44 centrally disposed on the lower wall 42. The first magnet 44 has an inner wall 46 embedded in the foot 40 and an outer wall 48 coplanar with the lower wall 42. The first magnet 44 is engageable to a ferromagnetic mounting surface to secure the body 20 in an upright position atop the ferromagnetic mounting surface. Also, because the first magnet 44 outer wall 48 is coplanar with the lower wall 42 of the respective foot 40, rather than extending beyond the lower wall 42, the body 20 can be also be positioned atop a non-ferromagnetic mounting surface without being magnetically attached to the mounting surface.

A pair of spring-loaded clamps 50 is provided to attach the body 20 to a foldable floor-standing sign having a front panel and a rear panel pivotably connected to the front panel. Each clamp 50 has an upper side 52 and a second magnet 54 disposed on the upper side 52. The second magnet 54 of each clamp 50 is engageable to the first magnet 44 of one of the respective feet 40. Each clamp 50 has a maximum width "W" substantially equal to a combined width of an upper side of each of a front and rear panels of the foldable floor-standing sign from a forward side to a rearward side of the foldable floor-standing sign. Each clamp 50 is configured to securely clamp simultaneously across the upper side of and onto both of the front panel and the rear panels and to secure the body in an upright position atop the foldable floor-standing sign.

A lighting assembly 55 integrated within the body 20 is configured to produce lighting effects. The lighting assembly 55 includes a plurality of front lights 56 disposed on the front side and a plurality of rear lights 57 disposed on the rear side. A sound system 60 is also integrated within the body 20. The sound system 60 is configured to record, delete and play back a plurality of audible signals. The sound system 60 includes each of an amplified front speaker 62 and an amplified rear speaker 64.

A front motion sensor 70 and a rear motion sensor 72 are integrated within the body 20 on the front side 26 and the rear side 28, respectively. Each of the front and rear motion sensors 70, 72 is in operational communication with the lighting assembly 55 and the sound system 60. A microprocessor 75 has an integrated timer 77 therein and is also disposed within the body 20. The microprocessor 75 is in operational communication with a power source 79, the lighting assembly 55, the sound system 60, and the front and rear motion sensors 70, 72.

A switch 81 is disposed on the body 20 and is in operational communication with the microprocessor 75. The switch 81 has three operational positions: an on-position 83, an off-position 84 and an auto-position 85. The power source 79 is disposed within the body 20. The power source 79 is at least one battery. The power source 79 is in operational communication with the lighting assembly 55, the sound system 60, the front and rear motion sensors 70, 72, and the microprocessor 75.

A first portion of the audible signals comprises an audible message of "Caution Wet Floor". A second portion of the audible signals comprises an audible message recorded onto the microprocessor 75.

In the on-position, the switch 81 activates the microprocessor 75 whereupon the microprocessor 75 activates the sound system 60 to play back the first portion of the audible signals, activates the timer 77 to control the sound system 60 to play back one of the first portion and the second portion of the audible signals at one of a selected time interval, and activates the lighting assembly 55 to produce the lighting effects.

In the off-position, the switch 81 activates the microprocessor 75 whereupon the microprocessor 75 activates solely the lighting assembly 66 to produce the lighting effects.

In the auto-position, the switch 81 activates the microprocessor 75 whereupon the microprocessor 75 activates, solely upon the detection of motion by at least one of the front motion sensor and the rear motion sensor 70, 72, each of the sound system 60 to play back one of the first portion and the second portion of the audible signals and the lighting assembly 55 to produce the lighting effects.

The sound system 60 provides a built-in microphone 87 within the body 20. The microphone 87 is configured for receiving the second portion of the plurality of audible signals. The microphone is in operational communication with the microprocessor 75. Activation of the microphone 83 is configured to permit the recording of the second portion of the audible signals for storage and recording by the microprocessor 75. Each of the front and rear motion sensors 70, 72 is configured for detecting motion from a nearby pedestrian so as to activate the lighting assembly 55 and the sound system 60 when nearby pedestrian motion is detected.

What is claimed is:

1. A multi-media warning sign attachable to a floor sign comprising:

a body having a top side, a bottom side, a front side, a rear side, a right side, and a left side;

a foot attached to the bottom side proximal each of the right and left sides, each foot having a lower wall and a first magnet centrally disposed on the lower wall, the first magnet having an inner wall embedded in the foot and an outer wall coplanar with the lower wall;

a pair of spring-loaded clamps, each clamp having an upper side and a second magnet disposed on the upper side, the second magnet of each clamp engageable to the first magnet of the respective foot, wherein each clamp has a maximum width substantially equal to a combined width of an upper side of each of a front panel and a rear panel pivotably connected to the front panel of a foldable floor-standing sign from a forward side to a rearward side of the foldable floor-standing sign, each clamp configured to securely clamp simultaneously across the upper side of and onto both of the front panel and the rear panel of the foldable floor-standing sign and to secure the body in an upright position atop the foldable floor-standing sign;

a lighting assembly integrated within the body, the lighting assembly being configured to produce lighting effects;

a sound system integrated within the body, wherein the sound system is configured to record, delete and play back a plurality of audible signals, the sound system including each of an amplified front speaker and an amplified rear speaker;

a front motion sensor and a rear motion sensor integrated within the body on the front side and the rear side, respectively, wherein each of the front and rear motion sensors is in operational communication with the lighting assembly and the sound system;

a microprocessor having an integrated timer therein, the microprocessor disposed within the body and being in operational communication with the lighting assembly, the sound system, and the front and rear motion sensors;

a switch disposed on the body, wherein the switch is in operational communication with the microprocessor, wherein the switch has three positions, wherein the three positions of the switch are an on-position, an off-position, and an auto-position; and a power source disposed within the body, wherein the power source is at least one battery, wherein the power source is in operational communication with the lighting assembly, the sound system, the front and rear motion sensors, and the microprocessor;

wherein a first portion of the plurality of audible signals comprises an audible message of "Caution Wet Floor" and wherein a second portion of the plurality of audible signals comprises an audible message recorded onto the microprocessor;

wherein in the on-position, the switch activates the microprocessor, wherein upon activation of the microprocessor by the switch in the on-position, the microprocessor activates the sound system to play back the first portion of the plurality of audible signals, activates the timer to control the sound system to play back one of the first portion and the second portion of the plurality of audible signals at one of a selected time interval, and activates the lighting assembly to produce the lighting effects;

wherein in the off-position, the switch activates solely the lighting assembly to produce the lighting effects; and wherein in the auto-position, the switch activates the microprocessor, wherein upon activation of the microprocessor by the switch in the auto-position, the microprocessor activates, solely upon the detection of motion by at least one of the front motion sensor and the rear motion sensor, each of the sound system to play back one of the first portion and the second portion of the plurality of audible signals and the lighting assembly to produce the lighting effects.

2. The multi-media warning sign attachable to the floor sign of claim 1 wherein the sound system provides a built-in microphone disposed within the body, wherein the microphone is configured for receiving the second portion of the plurality of audible signals, wherein the microphone is in operational communication with the microprocessor, wherein activation of the microphone is configured to permit the recording of the second portion of the plurality of audible signals for storage and processing by the microprocessor.

3. The multi-media warning sign attachable to the floor sign of claim 1 wherein each of the front and rear motion sensors is configured for detecting motion from a nearby pedestrian so as to activate the lighting assembly and the sound system when the nearby pedestrian motion is detected.

4. A multi-media warning sign attachable to a floor sign comprising:

a body having a top side, a bottom side, a front side, a rear side, a right side, and a left side;

a foot attached to the bottom side proximal each of the right and left sides, each foot having a lower wall and a first magnet centrally disposed on the lower wall, the first magnet having an inner wall embedded in the foot and an outer wall coplanar with the lower wall;

a pair of spring-loaded clamps, each clamp having an upper side and a second magnet disposed on the upper side, the second magnet of each clamp engageable to the first magnet of the respective foot, wherein each clamp has a maximum width substantially equal to a combined width of an upper side of each of a front panel and a rear panel pivotably connected to the front panel of a foldable floor-standing sign from a forward side to a rearward side of the foldable floor-standing sign, each clamp configured to securely clamp simultaneously across the upper side of and onto both of the front panel and the rear panel of the foldable floor-standing sign and to secure the body in an upright position atop the foldable floor-standing sign;

a lighting assembly integrated within the body, the lighting assembly comprising a plurality of front lights disposed on the front side and a plurality of rear lights disposed on the rear side, the lighting assembly being configured to produce lighting effects;

a sound system integrated within the body, wherein the sound system is configured to record, delete and play back a plurality of audible signals, the sound system including each of an amplified front speaker and an amplified rear speaker;

a front motion sensor and a rear motion sensor integrated within the body on the front side and the rear side, respectively, wherein each of the front and rear motion sensors is in operational communication with the lighting assembly and the sound system;

a microprocessor having an integrated timer therein, the microprocessor disposed within the body and being in operational communication the lighting assembly, the sound system, and the front and rear motion sensors;

a switch disposed on the body, wherein the switch is in operational communication with the microprocessor, wherein the switch has three operational positions, wherein the three operational positions of the switch are an on-position, an off-position, and an auto-position; and a power source disposed within the body, wherein the power source is at least one battery, wherein the power source is in operational communication with the lighting assembly, the sound system, the front and rear motion sensors, and the microprocessor;

wherein a first portion of the plurality of audible signals comprises an audible message of "Caution Wet Floor" and wherein a second portion of the plurality of audible signals comprises an audible message recorded onto the microprocessor;

wherein in the on-position, the switch activates the microprocessor, wherein upon activation of the microprocessor by the switch in the on-position, the microprocessor activates the sound system to play back the first portion of the plurality of audible signals, activates the timer to control the sound system to play back one of the first portion and the second portion of the plurality of audible signals at one of a selected time interval, and activates the lighting assembly to produce the lighting effects;

wherein in the off-position, the switch activates solely the lighting assembly to produce the lighting effects;

wherein in the auto-position, the switch activates the microprocessor, wherein upon activation of the microprocessor by the switch in the auto-position, the microprocessor activates, solely upon the detection of motion by at least one of the front motion sensor and the rear motion sensor, each of the sound system to play back one of the first portion and the second portion of the plurality of audible signals and the lighting assembly to produce the lighting effects;

wherein the sound system provides a built-in microphone, wherein the microphone is configured for receiving the second portion of the plurality of audible signals, wherein the microphone is in operational communication with the microprocessor, wherein activation of the microphone is configured to permit the recording of the second portion of the plurality of audible signals for storage and processing by the microprocessor; and wherein each of the front and rear motion sensors is configured for detecting motion from a nearby pedestrian so as to activate the lighting assembly and the sound system when the nearby pedestrian motion is detected.

* * * * *